US007243736B2

(12) United States Patent
Shah

(10) Patent No.: US 7,243,736 B2
(45) Date of Patent: Jul. 17, 2007

(54) METHOD OF CONTROLLING A WELL EXPERIENCING GAS KICKS

(76) Inventor: Javed Shah, 11135-23A Avenue, Edmonton, Alberta (CA) T6J 4W5

( * ) Notice: Subject to any disclaimer, the term of this patent is extended or adjusted under 35 U.S.C. 154(b) by 274 days.

(21) Appl. No.: 10/898,079

(22) Filed: Jul. 23, 2004

(65) Prior Publication Data

US 2005/0016724 A1 Jan. 27, 2005

(30) Foreign Application Priority Data

Jul. 25, 2003 (CA) ..... 2436134

(51) Int. Cl.
*E21B 21/08* (2006.01)

(52) U.S. Cl. ..... 175/48

(58) Field of Classification Search ..... 175/38, 175/48

See application file for complete search history.

(56) References Cited

U.S. PATENT DOCUMENTS 3,971,926 A * 7/1976 Gau et al. ..... 708/3
4,310,058 A * 1/1982 Bourgoyne, Jr. ..... 175/48
5,080,182 A * 1/1992 Thompson ..... 175/48
2002/0066571 A1* 6/2002 Schubert et al. ..... 166/363
2002/0066597 A1* 6/2002 Schubert et al. ..... 175/38
2003/0168258 A1* 9/2003 Koederitz ..... 175/38
2005/0096848 A1* 5/2005 Hou et al. ..... 702/9
2006/0207795 A1* 9/2006 Kinder et al. ..... 175/38

* cited by examiner

*Primary Examiner*—Jennifer H. Gay
*Assistant Examiner*—Robert E Fuller
(74) *Attorney, Agent, or Firm*—Davis Bujold & Daniels, P.L.L.C.

(57) ABSTRACT

A method of controlling a well experiencing gas kicks, which includes the step of increasing pressure above maximum allowable casing pressure to offset decreases in circulating pressure. The method includes calculating a difference between initial circulating pressure and present circulating pressure to arrive at a net loss in circulating pressure. Pressure is increased above maximum allowable casing pressure by an amount approximating the net loss in circulating pressure.

3 Claims, No Drawings

METHOD OF CONTROLLING A WELL EXPERIENCING GAS KICKS

This application claims priority from Canadian Application Serial No. 2,436,134 which was filed on Jul. 25, 2003.

FIELD OF THE INVENTION

The present invention relates to method of controlling a well experiencing gas kicks, as a precursor to a possible blow out condition.

BACKGROUND OF THE INVENTION

In the oil fields, the accepted rule is not to exceed the maximum allowable casing pressure, hereafter referred to as the MACP, while circulating the kick out of the well.

MACP is, consequently, not exceeded, even when gas is at surface.

At a typical well site, a MACP number (with gas at surface) is posted at the rig on the assumption that all the mud from the annulus has been displaced by gas. A new MACP number can be calculated with gas at surface, by multiplying the "Leak off" gradient with the shoe depth. In this method of calculating the MACP, gas density is ignored, without any consideration being given to the amount of gas in the returning mud giving a very high number for MACP. In actuality, after setting the casing, a leak off test is not usually done. Rather the leak off gradient is assumed to be 18.1 kPa/m. The formation may or may not hold this equivalent leak off gradient. In the absence of a leak off test, there is a concern as to the integrity of the cement job on the casing. Even if a leak off test is conducted, as soon as the drilling continues further, the open hole section exposed below the shoe is not tested to more than the Annular Pressure Loss and the hydrostatic pressure.

Pressure test # 1 is Hydrostatic pressure+Annular Pressure Loss which is a normal pressure on an open hole while drilling.

The first real pressure test on the open hole is the Shut In Drill Pipe Pressure above the hydrostatic pressure.

Pressure test # 2 is Shut In Drill Pipe Pressure plus hydrostatic pressure which is the pressure applied to open hole/well during shut in. This test is like a reverse "Leak off" test. Pressure is applied by the formation instead of a high pressure pump.

Most often the room to MACP which is the difference between Shut In Casing Pressure and Max allowable casing pressure, is a function of kick volume in the well and not a function of abnormal formation pressure. Therefore the bigger the kick taken the more chances that MACP will be reached during the circulation.

During the circulation of the kick the well is subjected to pressure test #3 which is Shut In Drill Pipe Pressure plus Hydrostatic Pressure+Annular Pressure Loss. This is the pressure applied to the open hole during kick circulation. Once the initial circulation pressure is established, without a drop in the drill pipe pressure, the open hole is capable of handling the applied pressure.

Pressure test #4 is where the established pressure is RSPP+Shut In Drill Pipe Pressure+Annular Pressure Loss+Overkill, if any is used.

Modified low choke method of well control presently reads that the MACP should be held constant throughout the circulation. This allows the second kick to be smaller than the first kick. This is only possible if there is a big difference between the Shut In Casing Pressure and the MACP or the MACP is reached when the gas is close to surface.

Usually this does not happen. By the time the first kick reaches surface, the choke being used is wide open and the second choke has to be opened to stay below the MACP. This move results in further lowering the bottom hole pressure due to the fact that the friction pressure through the choke is already dropping as gas cut mud is leaving the wellbore. If this mode of operation is kept up, most of the mud is displaced from the well. In a worst case scenario, the gut line is opened to allow the mud to escape to the flare pit. During this time the drill pipe pressure keeps dropping as there is the least amount of resistance to flow.

SUMMARY OF THE INVENTION

What is required is an alternative method of controlling a well experiencing gas kicks.

According to the present invention there is provided a method of controlling a well experiencing gas kicks, which includes the step of increasing pressure above maximum allowable casing pressure to offset decreases in circulating pressure. The method includes calculating a difference between initial circulating pressure and present circulating pressure to arrive at a net loss in circulating pressure. Pressure is increased above maximum allowable casing pressure by an amount approximating the net loss in circulating pressure.

DETAILED DESCRIPTION OF THE PREFERRED EMBODIMENT

The preferred method of controlling a well experiencing gas kicks, will now be described.

According to the present invention, there is provided a method of controlling a well experiencing gas kicks, which includes the step of increasing pressure above maximum allowable casing pressure to offset decreases in circulating pressure. A difference is calculated between initial circulating pressure and present circulating pressure to arrive at a net loss in circulating pressure. Pressure is increased above maximum allowable casing pressure by an amount approximating the net loss in circulating pressure. A further step includes returning the pressure to maximum allowable casing pressure when circulating pressure returns to initial circulating pressure.

It is common knowledge that the Hydrostatic pressure at the casing shoe reduces drastically once the gas is at surface. With gas at surface, if the choke is closed instead of being opened the casing pressure starts to rise and MACP is exceeded. The bottom hole pressure also starts to increase. The entry of the second kick starts to slow down. At this time a reduction in the Pit Volume is observed. An increase in the drill pipe pressure is noted as the hydrostatic pressure in the annulus starts to increase. As soon as the Drill Pipe pressure reaches the Original Established Pressure (#4) the operator can maintain the circulating Drill pipe pressure. Although the MACP has been exceeded, the well has not seen any extra pressure than what was already applied to it earlier in the circulation.

In a situation where the operator is already at MACP as soon as an attempt is made to shut in the well, the same approach can be taken and casing pressure can be increased gradually. If the drill pipe pressure keeps increasing along with a reduction in the pit volume, the well bore integrity is apparent under dynamic conditions. If, while increasing the casing pressure, no increase in drill pipe pressure is observed, partial loss of circulation is indicated and the casing pressure can be backed off to cut down on the partial losses.

The industry has established the Low Choke Method to deal with the above mentioned situation, but there is no reference as to how much increase in density is taking place. If loss of circulation takes place the density can not be reduced until the higher density reaches surface. When it becomes necessary to exceed Maximum Allowable Casing Pressure, the guideline is to exceed MACP only when gas is at surface. This ensures that the total pressure at the casing shoe is significantly less than total pressure established at the time the leak off test was performed.

In order to accomplish this, the Maximum Drill Pipe circulating pressure that was recorded should be checked. The drop in Drill Pipe circulating pressure, from the pressure recorded should be established when the gas is at surface. With gas at surface, the choke is slowly closed to increase the casing pressure above the MACP, by 200 kPa at a time. The drill pipe pressure should respond by increasing the same amount as the casing pressure which is indicative of well bore integrity. The total tank volume should also start reducing to return to normal.

When the drill pipe pressure equals the original circulating pressure, the drill pipe pressure is held constant until all the gas is circulated out of the system. The well can then be shut in and preparation can be made to kill the well using the Driller's method.

By way of Example:

Shut In Drill Pipe Pressure 1000 kPa

Shut In Casing Pressure 1600 kPa

Initial Pit gain 2 M

MACP 1800 kPa

Initial Circulating Pressure 5000 kPa

Circulating Casing Pressure 1800 kPa

Circulation continues:

When Gas is at Surface the following is observed:

Pit gain 4.5 M3

Circulating Drill Pipe pressure 4200 kPa

Casing Pressure 1800 kPa

Pressure estimation for exceeding MACP:

Drop in Drill Pipe pressure (when gas is at surface)

ICP—Present circulating drill pipe pressure 5000 kPa-4200 kPa 800 kPa

New MACP 1800 kPa+800 kPa=2600 kPa

Revert to Drill Pipe pressure as soon as the drill pipe pressure returns to 5000 kPa.

The casing pressure will reduce to Shut In Drill Pipe Pressure+200 kPa as the gas is circulated out of hole.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of controlling a well experiencing a gas kick, the method comprising the steps of:

operating a drilling string at a well at an initial circulation pressure;

upon the well experiencing a gas kick, calculating a net loss circulating pressure and increasing a pressure at the surface, above a maximum allowable casing pressure, by an amount substantially equal to the net loss circulating pressure to offset any decrease in the initial circulating pressure within the well caused by the gas kick; and maintaining the increased pressure at the surface until the gas kick is substantially circulated out of the well and thereafter decreasing the pressure.

2. A method of controlling a well experiencing gas kicks by increasing a pressure at the surface above a maximum allowable casing pressure to offset decreases in circulating pressure, the method comprising the steps of:

calculating a difference between an initial circulating pressure and a present circulating pressure to arrive at a net loss in circulating pressure, and;

increasing the pressure at the surface above the maximum allowable casing pressure by an amount approximating the net loss in circulating pressure.

3. The method as defined in claim 2 including a further step of returning the pressure to at the surface the maximum allowable casing pressure when the circulating pressure returns to the initial circulating pressure.

* * * * *